US010107477B2

(12) United States Patent
Scott et al.

(10) Patent No.: US 10,107,477 B2
(45) Date of Patent: Oct. 23, 2018

(54) LED LIGHT USING INTERNAL REFLECTOR

(75) Inventors: Keith Scott, Livermore, CA (US); Todd Farmer, Livermore, CA (US)

(73) Assignee: BRIDGELUX INC., Fremont, CA (US)

( * ) Notice: Subject to any disclaimer, the term of this patent is extended or adjusted under 35 U.S.C. 154(b) by 0 days.

(21) Appl. No.: 13/294,839

(22) Filed: Nov. 11, 2011

(65) Prior Publication Data

US 2012/0099311 A1 Apr. 26, 2012

Related U.S. Application Data

(60) Provisional application No. 61/412,749, filed on Nov. 11, 2010.

(51) Int. Cl.
*F21V 7/06* (2006.01)
*F21S 8/08* (2006.01)
(Continued)

(52) U.S. Cl.
CPC ..... *F21V 7/06* (2013.01); *F21S 8/086* (2013.01); *F21W 2131/103* (2013.01); *F21Y 2115/10* (2016.08)

(58) Field of Classification Search
CPC ..... F21S 6/007; F21S 8/086; F21V 7/083
(Continued)

(56) References Cited

U.S. PATENT DOCUMENTS 3,071,683 A * 1/1963 Queale ..... F21S 8/086 248/214
7,434,959 B1 * 10/2008 Wang ..... 362/249.01
(Continued)

FOREIGN PATENT DOCUMENTS

CN 101253444 A 8/2008
JP 2004296245 A 10/2004
(Continued)

OTHER PUBLICATIONS

Notification of Transmittal of the International Search Report and the Written Opinion of the International Searching Authority, or the Declaration, International Search Report and Written Opinion in International Application No. PCT/US2011/060070.
(Continued)

*Primary Examiner* — Robert May
*Assistant Examiner* — Leah S Macchiarolo
(74) *Attorney, Agent, or Firm* — Arent Fox LLP

(57) ABSTRACT

A street light includes a pole and a head attached to the pole. The head includes a light emitting element comprising a plurality of solid state light emitting devices, an optical element, and a reflector configured to reflect light emitted by the solid state light emitting devices to the optical element to produce a light distribution pattern from the head. The light emitted from the solid state emitting devices may be Lambertian patterned light. The Lambertian patterned light may be used to illuminate the reflector. The reflector may be used to transform the Lambertian patterned light to collimated light and direct the collimated light towards the optical element. The optical element may be configured to produce the light distribution pattern from the collimated light.

13 Claims, 5 Drawing Sheets

(51) Int. Cl.
*F21W 131/103* (2006.01)
*F21Y 115/10* (2016.01)

(58) Field of Classification Search
USPC ..... 362/431, 235, 576, 153.1, 245, 246, 362/249.02, 311.01, 311.02
See application file for complete search history.

(56) References Cited

U.S. PATENT DOCUMENTS

| | | | | |
|---|---|---|---|---|
| 7,441,930 | B2 * | 10/2008 | Lin | 362/410 |
| 7,828,463 | B1 * | 11/2010 | Willis | 362/276 |
| 2004/0196653 | A1 * | 10/2004 | Clark et al. | 362/183 |
| 2007/0230171 | A1 | 10/2007 | Hiratsuka | |
| 2008/0151576 | A1 | 6/2008 | Inditsky | |
| 2009/0283779 | A1 | 11/2009 | Negley et al. | |
| 2009/0303715 | A1 | 12/2009 | Takasago et al. | |
| 2010/0182784 | A1 * | 7/2010 | Foo | 362/235 |
| 2011/0261565 | A1 * | 10/2011 | Gerli | F21V 7/0008 362/235 |
| 2012/0206927 | A1 * | 8/2012 | Miyahara | 362/382 |

FOREIGN PATENT DOCUMENTS

| | | | |
|---|---|---|---|
| JP | 2006005264 | A | 1/2006 |
| JP | 2006202612 | A | 8/2006 |
| JP | 2006313717 | A | 11/2006 |
| JP | 2007188832 | A | 7/2007 |
| JP | 2008091140 | A | 4/2008 |
| JP | 2008159554 | A | 7/2008 |
| JP | 2008235824 | A | 10/2008 |
| JP | 2008251663 | A | 10/2008 |
| JP | 2009021264 | A | 1/2009 |
| JP | 2009032590 | A | 2/2009 |
| TW | 1291568 | B | 12/2007 |
| TW | M325433 | U | 1/2008 |

OTHER PUBLICATIONS

Notification Concerning Transmittal of International Preliminary Report on Patentability, International Search Report and Written Opinion in International Application No. PCT/US2011/060070 dated May 23, 2013.

Office Action Issued for Japanese Patent Application 2012-514097 dated Mar. 5, 2013, based on the PCT application No. PCT/US2010/037119.

Taiwan Office Action dated Jul. 28, 2014, regarding Taiwan Application No. TW100141188.

First Office Action dated Feb. 7, 2014 regarding Taiwan Patent Application No. 100141188.

* cited by examiner

LED LIGHT USING INTERNAL REFLECTOR

CROSS-REFERENCE TO RELATED APPLICATIONS

This application claims priority Provisional Application No. 61/412,749 entitled "LED STREET LIGHT USING INTERNAL REFLECTOR" filed Nov. 11, 2010, and is expressly incorporated herein by reference.

BACKGROUND

Field

The present disclosure relates to light sources, and more particularly to light sources with solid state light emitting devices for light fixture applications.

Background

Solid state light emitting devices, such as light emitting diodes (LEDs), are attractive candidates for replacing conventional light sources such as incandescent, halogen and fluorescent lamps. LEDs have substantially higher light conversion efficiencies than incandescent and halogen lamps and longer lifetimes than all three of these types of conventional light sources. In addition, some types of LEDs now have higher conversion efficiencies than fluorescent light sources and still higher conversion efficiencies have been demonstrated in the laboratory. Finally, LEDs require lower voltages than fluorescent lamps and contain no mercury or other potentially dangerous materials, therefore, providing various safety and environmental benefits.

More recently, solid state devices have been used to replace high-intensity discharge (HID) lamps to provide high levels of light over large areas when energy efficiency and/or light intensity are required. These areas include roadways, parking lots, pathways, large public areas, and other outdoor applications. To increase the intensity of light in these applications, often more than one solid state light emitting device is arranged in a package. An example of a solid state light emitting device is a light emitting semiconductor chip comprising a p-n junction. An example of a package is a collection of light emitting devices arranged on a substrate and encapsulated in a phosphor to produce broad spectrum white light. This package is sometimes referred to as an "LED array." A heat sink is often attached to the LED array to dissipate heat generated by the light emitting devices.

Flexibility in designing lighting fixtures for varying illumination requirements remains as one of the challenges in designing modular solid state light emitting devices for high luminance applications, and a modular solution to lamp design in such devices is beneficial. For example, existing street lights and lamps are designed to accept more conventional lighting. An apparatus for providing an LED based replacement for conventional lighting is desired.

SUMMARY

In one aspect of the present disclosure, a light is disclosed with a pole and a head attached to the pole. The head includes a light source comprising a plurality of solid state light emitting devices, an optical element, and a reflector configured to reflect light emitted by the solid state light emitting devices to the optical element to produce a light distribution pattern from the head.

In another aspect of the present disclosure, a light is disclosed with a pole and a head attached to the pole. The head includes a light source comprising a plurality of solid state light emitting devices configured to emit Lambertian light, an optical element, and a reflector configured to transform the Lambertian light to collimated light and direct the collimated light towards the optical element.

In a further aspect of the present disclosure, a light is disclosed with a pole and a head attached to the pole. The head includes a ceiling, an emission aperture opposite the ceiling, a reflector attached to the ceiling, an optical element positioned in the emission aperture, and a light source positioned between the reflector and the optical element, wherein the light source comprises a plurality of solid state light arranged illuminate the reflector.

It is understood that other aspects of the present invention will become readily apparent to those skilled in the art from the following detailed description, wherein it is shown and described only exemplary configurations of a light source by way of illustration. As will be realized, the present invention includes other and different aspects of a light source and its several details are capable of modification in various other respects, all without departing from the spirit and scope of the present invention. Accordingly, the drawings and the detailed description are to be regarded as illustrative in nature and not as restrictive.

BRIEF DESCRIPTION OF THE FIGURES

Various aspects of the present invention are illustrated by way of example, and not by way of limitation, in the accompanying drawings, wherein.

DETAILED DESCRIPTION

Figure 1:
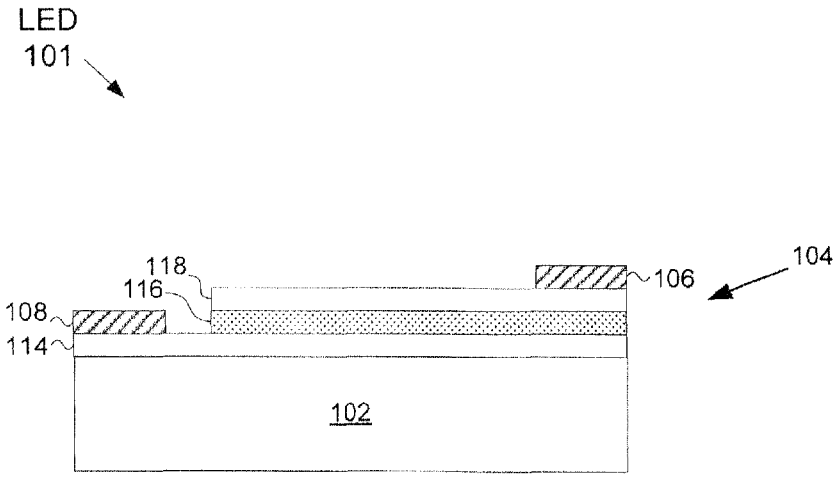
FIG. 1 is a conceptual cross-sectional side view illustrating an example of an LED.

The present invention is described more fully hereinafter with reference to the accompanying drawings, in which various aspects of the present invention are shown. This invention, however, may be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items The detailed description set forth below in connection with the appended drawings is intended as a description of various aspects of the present invention and is not intended to represent all aspects in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

Disclosed is an apparatus and method for retrofitting conventional lighting systems, such as, for example, street lights, with head including a light source comprising a plurality of solid state light emitting devices, an optical element, and a reflector configured to reflect light emitted by the solid state light emitting devices to the optical element to produce a light distribution pattern from the head. The light emitted from the solid state emitting devices may be Lambertian light. The Lambertian light may be used to illuminate the reflector. The reflector may be used to transform the Lambertian light to collimated light and direct the collimated light towards the optical element. The optical element may be configured to produce the light distribution pattern from the collimated light.

By way of example, and not in limitation, "street light" may refer to any lighting system that provides any illumination to a street, road, walkway, tunnel, park, outdoor facility, parking lot, etc. A "pole" may refer any structure for supporting a lighting system, including but not limited to, for example, a lamp post, hi-bay support, wall mounting, suspended hanging fixture, support frame, ceiling mount, or the like. A "thermal management system" may comprise at least one of a heat sink, heat spreader, heat fin, heat pipe, thermal interface material, active air movement devices, etc.

An example of a solid state light emitting device is an LED. The LED is well known in the art, and therefore, will only briefly be discussed to provide a complete description of the invention. FIG. 1 is a conceptual cross-sectional side view illustrating an example of an LED. An LED is a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, referred to as an n-type or p-type semiconductor region, respectively. In LED applications, the semiconductor includes an n-type semiconductor region and a p-type semiconductor region. A reverse electric field is created at the junction between the two regions, which cause the electrons and holes to move away from the junction to form an active region. When a forward voltage sufficient to overcome the reverse electric field is applied across the p-n junction, electrons and holes are forced into the active region and combine. When electrons combine with holes, they fall to lower energy levels and release energy in the form of light.

Referring to FIG. 1, the LED 101 includes a substrate 102, an epitaxial-layer structure 104 on the substrate 102, and a pair of electrodes 106 and 108 on the epitaxial-layer structure 104. The epitaxial-layer structure 104 comprises an active region 116 sandwiched between two oppositely doped epitaxial regions. In this example, an n-type semiconductor region 114 is formed on the substrate 102 and a p-type semiconductor region 118 is formed on the active region 116, however, the regions may be reversed. That is, the p-type semiconductor region 118 may be formed on the substrate 102 and the n-type semiconductor region 114 may formed on the active region 116. As those skilled in the art will readily appreciate, the various concepts described throughout this disclosure may be extended to any suitable epitaxial-layer structure. Additional layers (not shown) may also be included in the epitaxial-layer structure 104, including but not limited to buffer, nucleation, contact and current spreading layers as well as light extraction layers.

The electrodes 106 and 108 may be formed on the surface of the epitaxial-layer structure 104. The p-type semiconductor region 118 is exposed at the top surface, and therefore, the p-type electrode 106 may be readily formed thereon. However, the n-type semiconductor region 114 is buried beneath the p-type semiconductor region 118 and the active region 116. Accordingly, to form the n-type electrode 108 on the n-type semiconductor region 114, a portion of the active region 116 and the p-type semiconductor region 118 is removed to expose the n-type semiconductor region 114 therebeneath. After this portion of the epitaxial-layer structure 104 is removed, the n-type electrode 108 may be formed.

Figure 2:
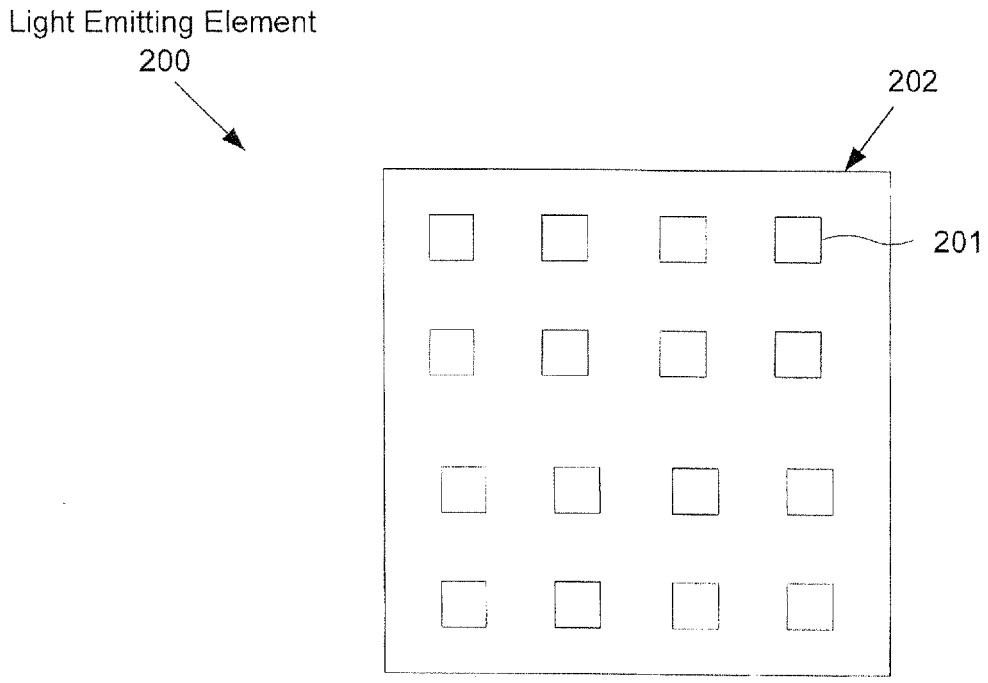
FIG. 2 is a conceptual plan view illustrating an example of a light emitting element.

One or more LEDs may be used to construct a light emitting element. A light emitting element having multiple solid state light emitting devices, such as LEDs, disposed on a single substrate, as will be described in connection with FIG. 2, is sometimes referred to as an "LED array." However, as those skilled in the art will readily appreciate, the present invention is not limited to LED arrays, and may be extended to any suitable LED device or other suitable solid state light source. One example of an LED device will now be presented with reference to FIG. 2. FIG. 2 is a conceptual top view illustrating an example of light emitting element 200. In this example, a light emitting element 200 is configured with multiple LEDs 201 arranged on a substrate 202. The substrate 202 may be made from any suitable material that provides mechanical support to the LEDs 201. Preferably, the material is thermally conductive to dissipate heat away from the LEDs 201. The substrate 202 may include a dielectric layer (not shown) to provide electrical insulation between the LEDs 201. The LEDs 201 may be electrically coupled in parallel and/or series by a conductive circuit layer, wire bonding, or a combination of these or other methods on the dielectric layer.

The light emitting element 200 may be configured to produce white light. White light may enable the LED device to act as a direct replacement for conventional light sources used today in incandescent, halogen, fluorescent, HID, and other suitable lamps. There are at least two common ways of producing white light. One way is to use individual LEDs that emit wavelengths (such as red, green, blue, amber, or other colors) and then mix all the colors to produce white light. The other way is to use a phosphor material or materials to convert monochromatic light emitted from a blue or ultra-violet (UV) LED to broad-spectrum white light. The present invention, however, may be practiced with other LED and phosphor combinations to produce different color lights.

Figure 3A:
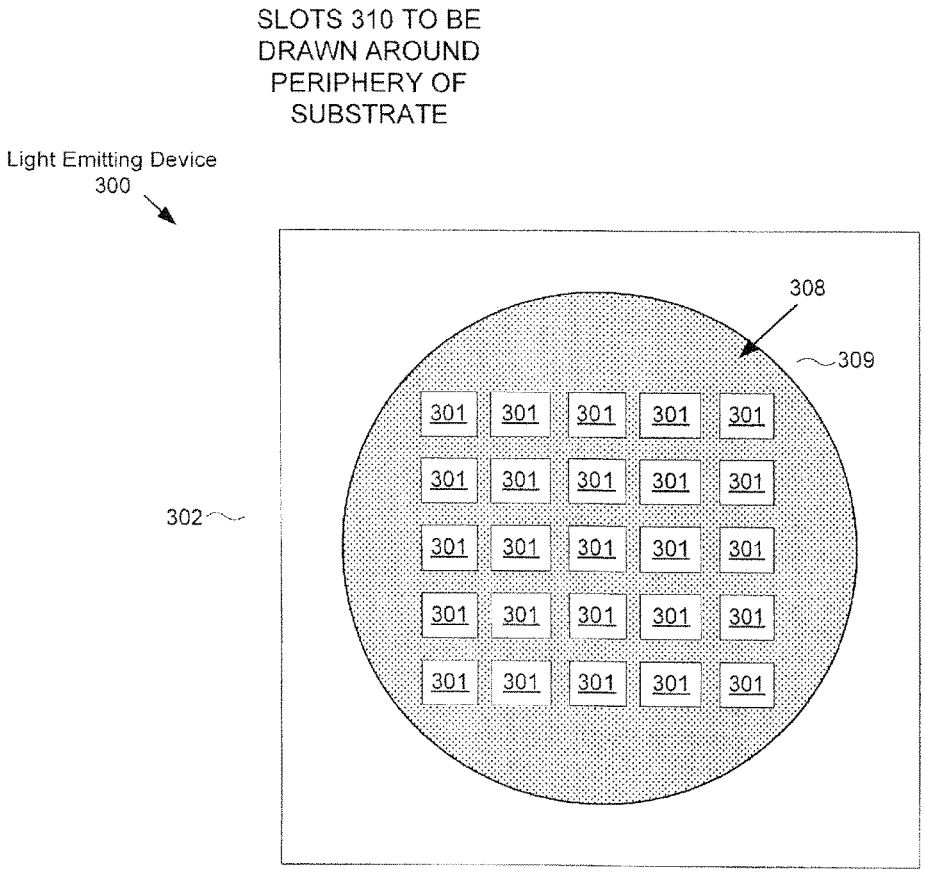
FIG. 3A is a conceptual top view illustrating an example of a white light source.
Figure 3B:
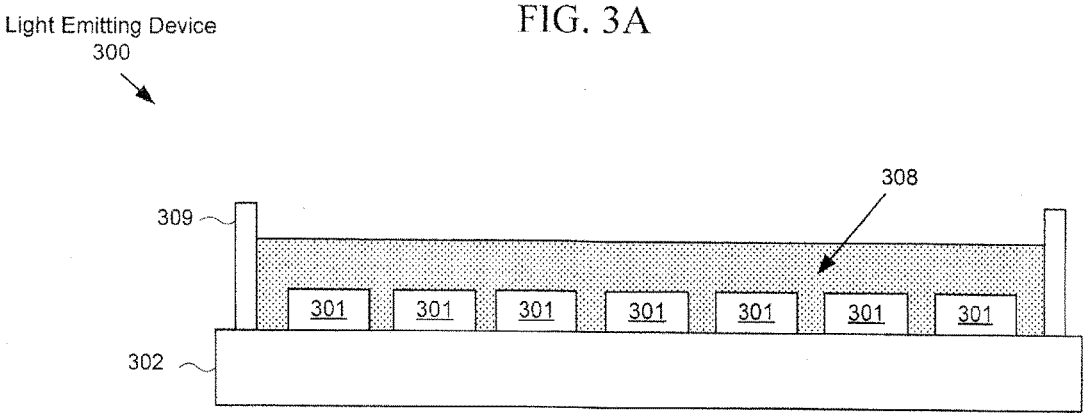
FIG. 3B is a conceptual cross-sectional side view of the white light source in FIG. 3A.

An example of a LED device will now be presented with reference to FIG. 3. FIG. 3A is a conceptual top view illustrating an example of a white light LED device and FIG. 3B is a conceptual cross-sectional side view of the white light LED device in FIG. 3A. The white light LED device 300 is shown with a substrate 302 which may be used to support multiple LEDs 301. The substrate 302 may be configured in a manner similar to that described in connection with FIG. 2 or in some other suitable way. In this example, the substrate includes a plurality of slots 310 along the periphery. A phosphor material 308 may be deposited within a cavity defined by an annular, or other shaped, or other boundary 309 that extends circumferentially, or in any shape, around the upper surface of the substrate 302 using, for example the slots 310. The annular boundary 309 may be formed with a suitable mold, or alternatively, formed separately from the substrate 302 and attached to the substrate 302 using an adhesive or other suitable means. The phosphor material 308 may include, by way of example, phosphor particles suspended in an epoxy, silicone, or other carrier or may be constructed from a soluble phosphor that is dissolved in the carrier.

In an alternative configuration of a white light emitting element, each LED may have its own phosphor layer. As those skilled in the art will readily appreciate, various configurations of LEDs and other light emitting cells may be used to create a white light emitting element. Moreover, as noted earlier, the present invention is not limited to solid state lighting devices that produce white light, but may be extended to solid state lighting devices that produce other colors of light.

Various aspects of a street light will now be presented. However, as those skilled in the art will readily appreciate, these aspects may be extended to other apparatus without departing from the spirit and scope of the invention. Generally, street lights may be designed to provide improved visibility and increased safety on a roadway while making the efficient use of energy. A street light design may be concerned with providing a specified level of illumination for a particular light distribution pattern. The Illumination Engineering Society (IES) has established a series of lateral distribution patterns designated as Types I, II, III, IV, and V. High intensity discharge (HID) lamps may be used a light sources for street lights. Further, LEDs may be attractive candidates for replacing HID lamps.

Figure 4:
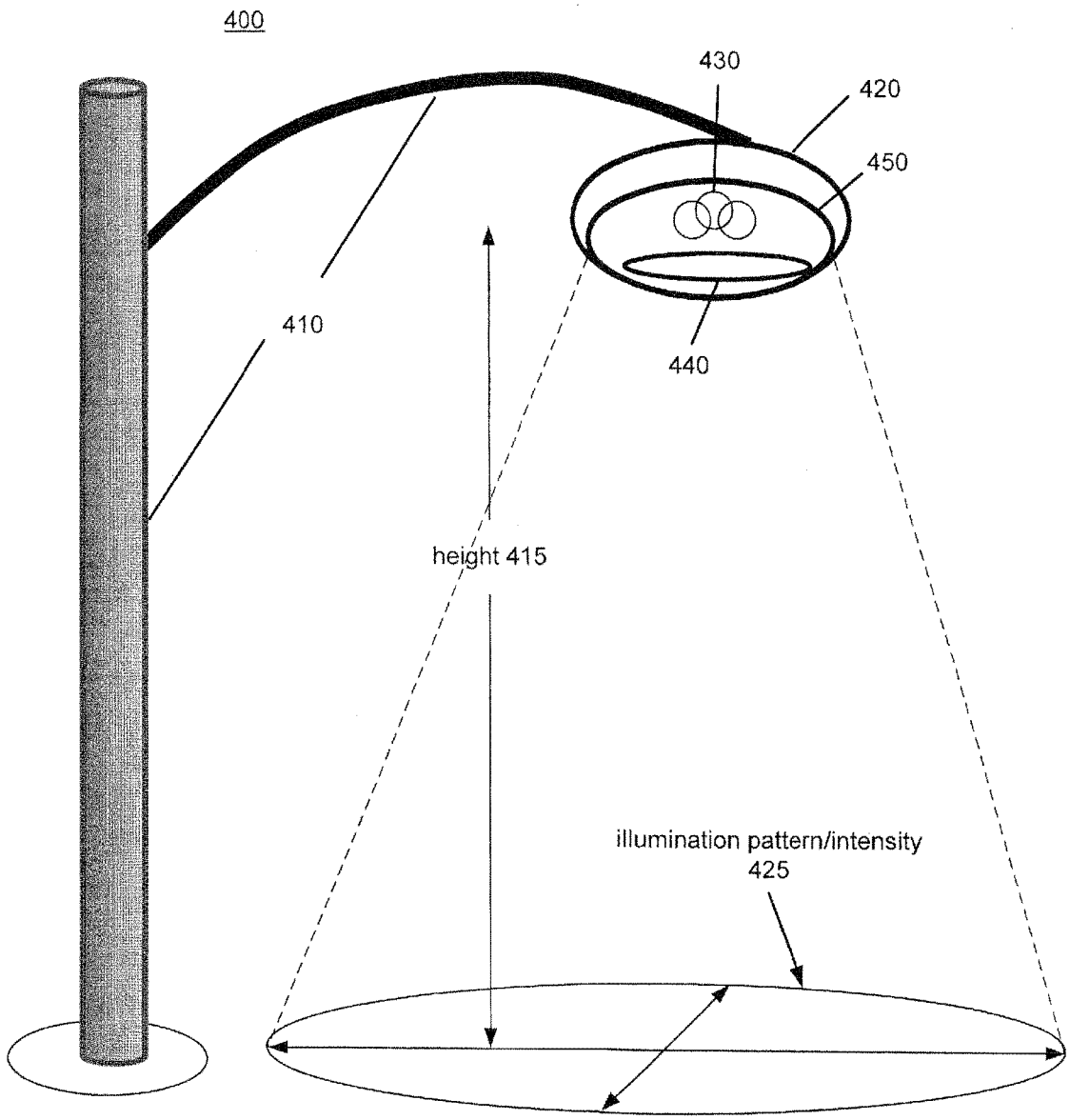
FIG. 4 is an example of an application of solid state light emitting devices to a street lamp.

FIG. 4 is an example of an application of solid state light emitting devices to a street lamp 400. The street light 400 may include a pole 410 and a head 420 attached to the pole. An example head 420 is depicted with respect to FIG. 5. The head 420 may include a light source including a plurality of solid state light emitting devices 430, an optical element 440, and a reflector 450 configured to reflect light emitted by the solid state light emitting devices 430 to the optical element 440 to produce a light distribution pattern 425 from the head.

In one aspect, the light emitted from the solid state emitting devices 430 may be Lambertian patterned light. In such an aspect, the Lambertian patterned light may be used to illuminate the reflector 450. Further, the reflector may be used to transform the Lambertian patterned light to collimated light and direct the collimated light towards the optical element 440. In one aspect, the optical element 440 may be configured to produce the light distribution pattern 425 from the collimated light.

In another aspect, among the characteristics that may be taken into account to select an array size of solid state light emitting devices 430 and the properties of the optical element 440, are included the height 415 of the lamp post 410, and the illumination pattern/intensity 425 sought for the application.

In operation, an LED street light may be realized with an LED (or LED array), a reflector, and optics. In one aspect of a street light, a reflector may be mounted to the ceiling of the head portion of the street light and an LED (or LED array) may be positioned within the head portion to emit light upwards towards the reflector. As such, the reflector may be used to generate a collimated light beam directed downward towards a roadway, or the like. In one aspect, the collimated light beam may emulate a point source of light, which enables the lateral distribution pattern (e.g., Type I, II, III, IV, or V) to be determined by the design of an optical element positioned below the LED (or LED array). The optical element may be a glass plate with a diffusing film, or some other suitable optic.

Figure 5:
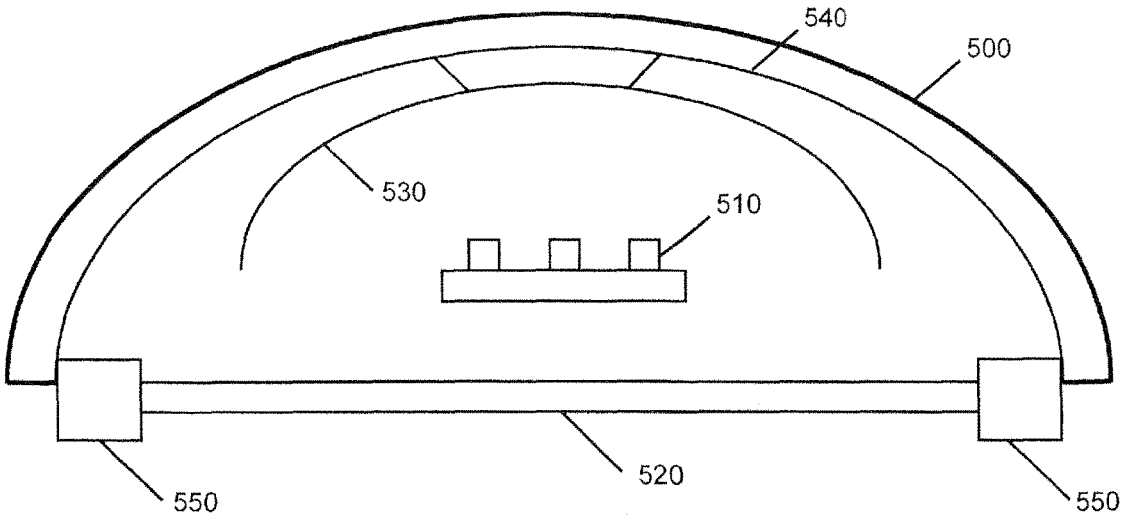
FIG. 5 is a conceptual cross-sectional view of a head of a street lamp.

FIG. 5 is an example cross section of a head 500 associated with a street lamp. The head may include a light source including a plurality of solid state light emitting devices 510, an optical element 520, and a reflector 530 configured to reflect light emitted by the solid state light emitting devices 510 to the optical element 520 to produce a light distribution pattern from the head.

In one aspect, the head 500 may include a ceiling 540 and the reflector 530 may be attached the ceiling 540. In another aspect, the head 500 may include an emission aperture 550 and the optical element 520 may be positioned in the emission aperture 550. Further, in such an aspect, the emission aperture may be placed opposite the ceiling 540 in the head 500. Still further, the light emitting devices 510 may be placed between the ceiling 540 and the optical element 520 in the emission aperture 550. In one aspect, the optical element 520 may be a substantially transparent plate with a diffusing film. In another aspect, the optical element 520 may be flat. In one aspect, the reflector 530 may be parabolic. In such an aspect, the light emitting devices 510 may be positioned at the focus of the parabolic reflector 530.

The various aspects of a street light are provided to enable one of ordinary skill in the art to practice the present invention. Various modifications to, and alternative configurations of, the street light presented throughout this disclosure will be readily apparent to those skilled in the art, and the concepts disclosed herein may be extended to other lighting applications. Thus, the claims are not intended to be limited to the various aspects of a street light presented throughout this disclosure, but are to be accorded the full scope consistent with the language of the claims. Thus, for example, lighting fixtures of any type, and for any lighting purpose, may be configured in accordance with the disclosure. All structural and functional equivalents to the elements of the various aspects of a light source described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. A light comprising:

a pole; and a head attached to the pole, wherein the head comprises:

a light emitting element comprising a plurality of solid state light emitting devices arranged on a planar substrate, an optical element continuous to the head, a single parabolic reflector configured to reflect Lambertian patterned light emitted by the solid state light emitting devices to the optical element to produce a uniform collimated light distribution pattern from the head, and a ceiling with at least a portion of the parabolic reflector attached to the ceiling, wherein the light emitting element is configured to emit the light upward toward the parabolic reflector, and the light emitting element is positioned between the parabolic reflector and the optical element and at a center focus of the parabolic reflector, and wherein the optical element is parallel to the planar substrate.

2. The light of claim 1, wherein the head comprises an emission aperture, and wherein the optical element is positioned in the emission aperture.

3. The street light of claim 1, wherein the head comprises an emission aperture opposite the ceiling, and wherein the optical element is positioned in the emission aperture.

4. The light of claim 1, wherein the optical element comprises a transparent plate having a diffusing film.

5. The light of claim 1, wherein the parabolic reflector produces collimated light.

6. The light of claim 5, wherein the optical element is configured to produce a light distribution pattern from the collimated light.

7. The light of claim 1, wherein the parabolic reflector is further configured to reflect the Lambertian patterned light by transforming the Lambertian patterned light to collimated light and directing the collimated light towards the optical element.

8. The light of claim 1, wherein the light is a street light.

9. A light comprising:

a pole; and a head attached to the pole, wherein the head comprises:

a light emitting element comprising a plurality of solid state light emitting devices supported by a substrate and configured to emit Lambertian patterned light, an optical element, a single concave parabolic reflector configured to transform the Lambertian patterned light to collimated light and direct the collimated light towards the optical element, and a ceiling with at least a portion of the concave parabolic reflector is attached to the ceiling, wherein the light emitting element is configured to emit the light upward toward the reflector, and wherein the light emitting element is positioned between the concave parabolic reflector and the optical element and fully within the edges of the concave parabolic reflector and at least below a vertex and at a center focus of the concave parabolic reflector, the light emitting element configured to emit a uniform collimated light distribution pattern.

10. The light of claim 9, wherein the head comprises an emission aperture, and wherein the optical element is in the emission aperture.

11. The light of claim 9, wherein the light emitting element is positioned in the focus of the concave parabolic reflector, and wherein the concave parabolic reflector produces collimated light.

12. The light of claim 9, wherein the optical element is configured to produce a light distribution pattern from the collimated light.

13. The light of claim 9, wherein the light is a street light.

* * * * *